US006117056A

United States Patent [19]

Cataldi, Jr. et al.

[11] Patent Number: 6,117,056

[45] Date of Patent: Sep. 12, 2000

[54] ISOTONIC EXERCISE DEVICE ATTACHABLE TO CHAIR

[75] Inventors: Theodore F. Cataldi, Jr., McKees Rocks; Brian F. Hagen, Wexford, both of Pa.

[73] Assignee: For You, Inc., McKees Rocks, Pa.

[21] Appl. No.: 09/298,099

[22] Filed: Apr. 22, 1999

[51] Int. Cl.[7] ..... A63B 21/02

[52] U.S. Cl. ..... 482/121; 482/123; 482/129; 482/130

[58] Field of Search ..... 482/904, 130, 482/129, 142, 121–128

[56] References Cited

U.S. PATENT DOCUMENTS

| | | | |
|---|---|---|---|
| 3,462,142 | 8/1969 | Sterndale . | |
| 3,751,031 | 8/1973 | Yamauchi . | |
| 4,685,671 | 8/1987 | Hagerman et al. | 482/124 |
| 5,141,482 | 8/1992 | Hern . | |
| 5,234,394 | 8/1993 | Wilkinson . | |
| 5,324,243 | 6/1994 | Wilkinson . | |
| 5,484,366 | 1/1996 | Wilkinson | 482/124 |
| 5,690,594 | 11/1997 | Mankovitz . | |
| 5,730,688 | 3/1998 | Prusick | 482/130 |
| 5,743,838 | 4/1998 | Willis . | |
| 5,752,909 | 5/1998 | Lee | 482/130 |
| 5,813,955 | 9/1998 | Gutkowski . | |
| 5,860,897 | 1/1999 | Gilbert et al. | 482/130 |

*Primary Examiner*—Jerome Donnelly
*Attorney, Agent, or Firm*—Clifford A. Poff

[57] ABSTRACT

An exercise device attachable to the seat portion of a chair to resist forces applied in performing isotonic exercises. The device includes a strap securable to a chair and a seat pad positionable on the strap for supporting an exerciser and has D-rings secured to the strap and the seat pad for attachment of an elastic band for performing arm isotonic exercises with a hand band attachment. The device also includes a front flap securable at one end between the seat pad and strap and securable at an opposite end to a downwardly forward portion of the chair for performing leg isotonic exercises with an attached elastic band and an ankle strap attachment.

20 Claims, 11 Drawing Sheets

ISOTONIC EXERCISE DEVICE ATTACHABLE TO CHAIR

BACKGROUND OF THE INVENTION

1. Field of the Invention

The present invention relates to an exercise device and more particularly to an exercise device attachable to a chair for performing isotonic arm, shoulder, back, chest, torso and lower extremities including foot and leg exercises utilizing elastic bands.

2. Description of the Prior Art

It is known in the art of exercise devices to provide a device attachable to a chair for performing isotonic exercises utilizing elastic members. These known devices are anchored or otherwise secured for support to the back or leg or a pedestal of a chair which severely limits the variety of different parts of the exerciser's body which can undergo isotonic exercises. Some isotonic exercise devices are bolted or constructed to be a permanent part of the chair, thus lack versatility and are not portable for use at diverse locations. Also, a chair when specially equipped with permanent exercising structure degrades the esthetic appearance of the chair. A need therefore exist for an isotonic exercise device attachable to a chair in a manner allowing for ease of detachment and provides versatility for a multiplicity of diverse isotonic exercises.

It is another object of the present invention to provide an exercise device which is attachable to the seat portion of a chair and when desired also attachable to a leg of the chair to provide resistive reactive forces placed on the device in the performance of isotonic exercise involving not only the exerciser's arms and upper torso but also the exerciser's legs.

It is a further object of the present invention to provide an exercise device embodying a construction and an arrangement of parts for attachment to the seat portion of a chair and present a exerciser support surface which when an exerciser is seated thereon utilizes the body weight of the exerciser to exert a force in a direction to augment the integrity of releasable connections between parts of the exercise device serving to resists the act of forces placed on the device during the performance of isotonic leg exercises.

SUMMARY OF THE INVENTION

According to the present invention there is provided an exercise device adapted for attachment to a chair. The exercise device includes a base pad of a sufficient size to allow body weight of an exerciser to provide a clamping force on the base pad against a seat portion of the chair; the base pad including strap end portions releasably interconnectable for securement to a part of the seat portion of a chair; and at least one of the base pad and the strap end portions including an elastic band secured thereto, the elastic band having a length sufficient to allow an exerciser to perform isotonic exercises.

In a preferred embodiment of the present invention, an elongated front flap including a flap attachment section extends to a flap anchor section supported by the base pad for positioning the attachment section at a site downwardly along a forward portion of the chair. The versatility of the invention provides that a first ankle strap including an elastic band can be secured to the attachment section for isotonic exercise and when desired a second anchor strap with or without an elastic band can be secured to the attachment section and a chair leg or the free leg of the exerciser to provide resistance against a reaction force imposed on the attachment section by the first ankle strap.

BRIEF DESCRIPTION OF THE DRAWINGS

These features and advantages of the present as well as others will be more fully understood when the following description is read in light of the accompanying drawings in which.

DETAILED DESCRIPTION OF THE PREFERRED EMBODIMENTS

Figure 1:
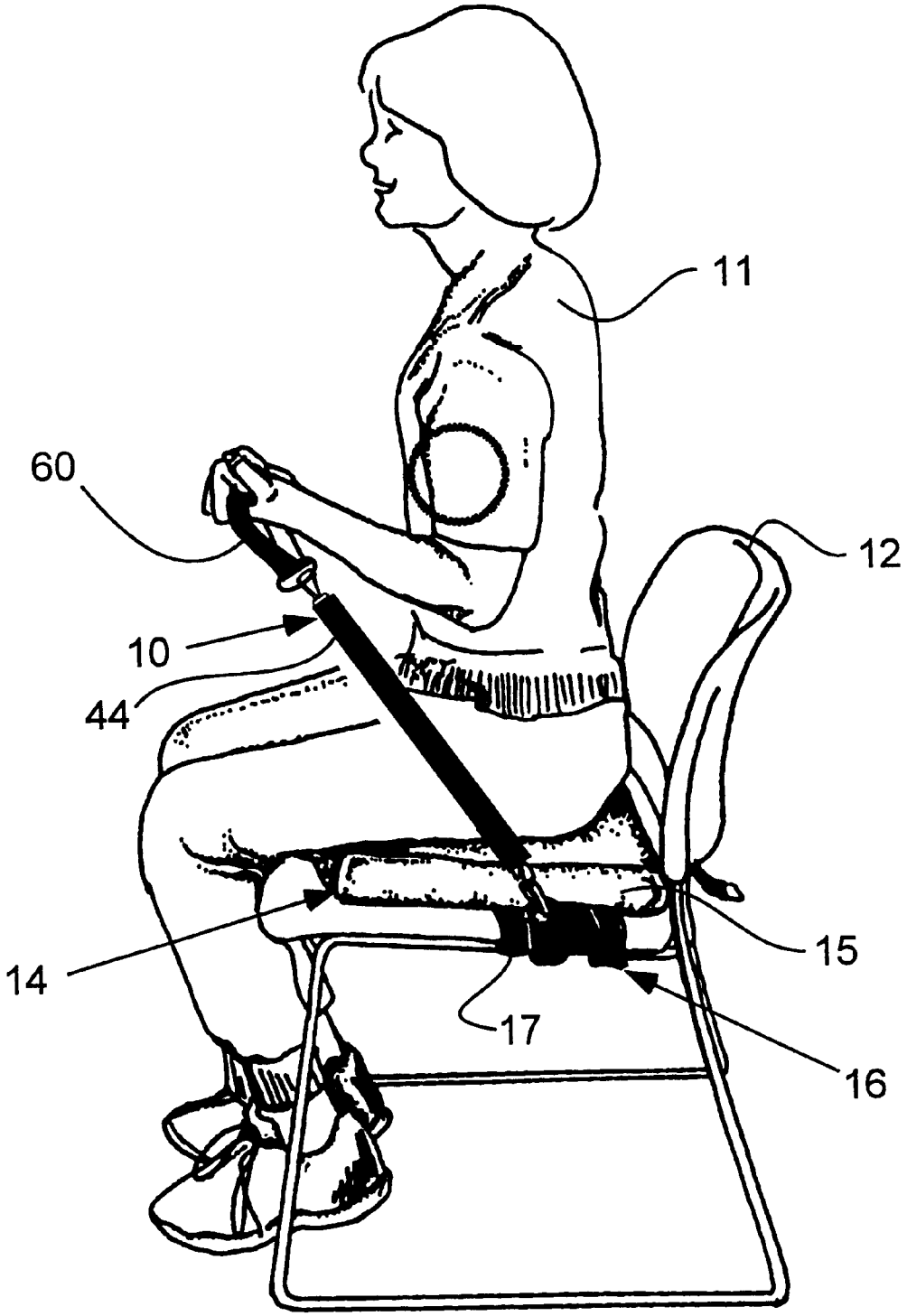
FIG. 1 is a perspective illustration of an exercise device according to the present invention attached to a chair and being used by an exerciser to perform an isotonic arm exercise.
Figure 2:
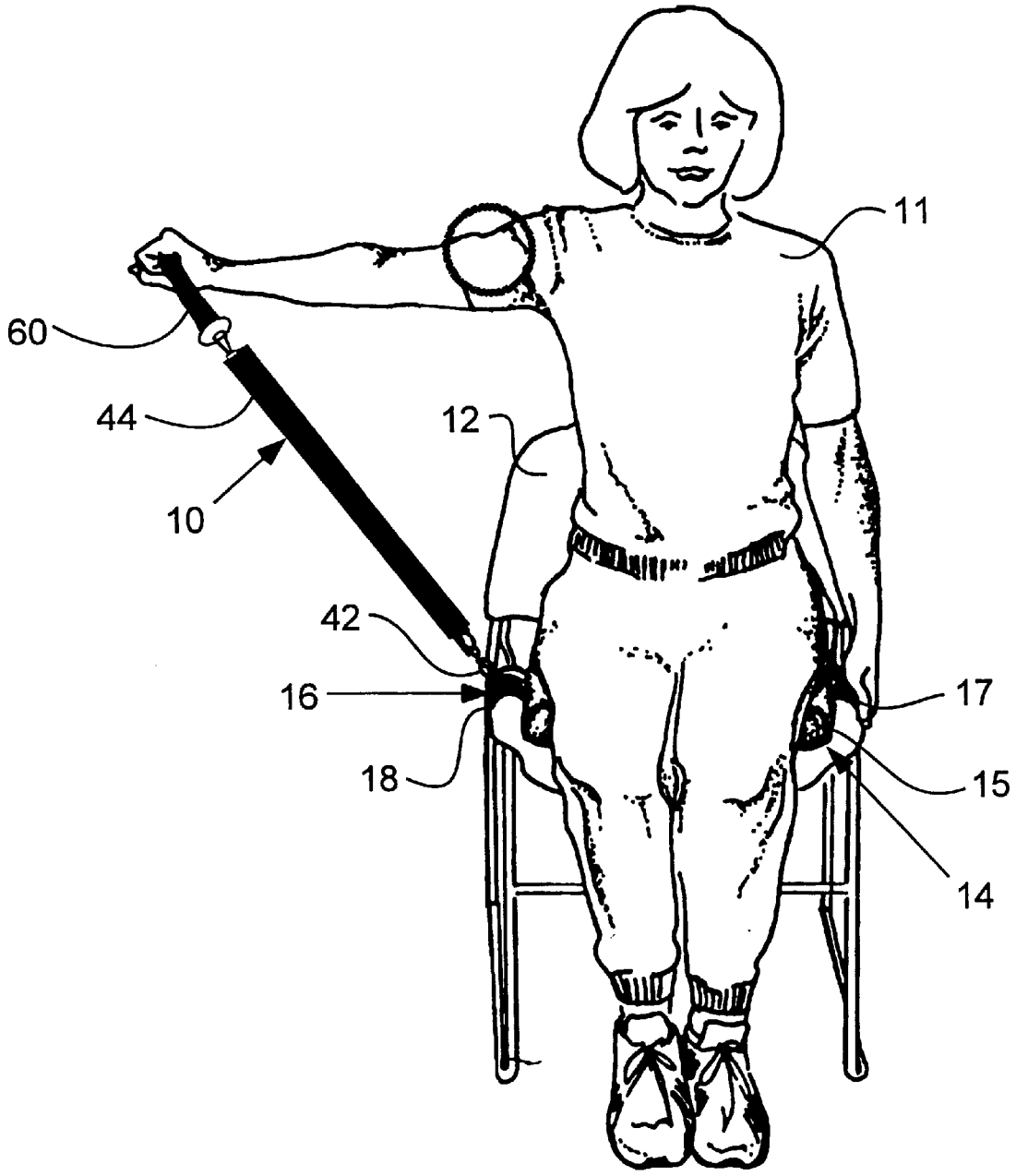
FIG. 2 is a perspective illustration of the exercise device of FIG. 1 being used by an exerciser to perform an isotonic arm exercise.
Figure 3:
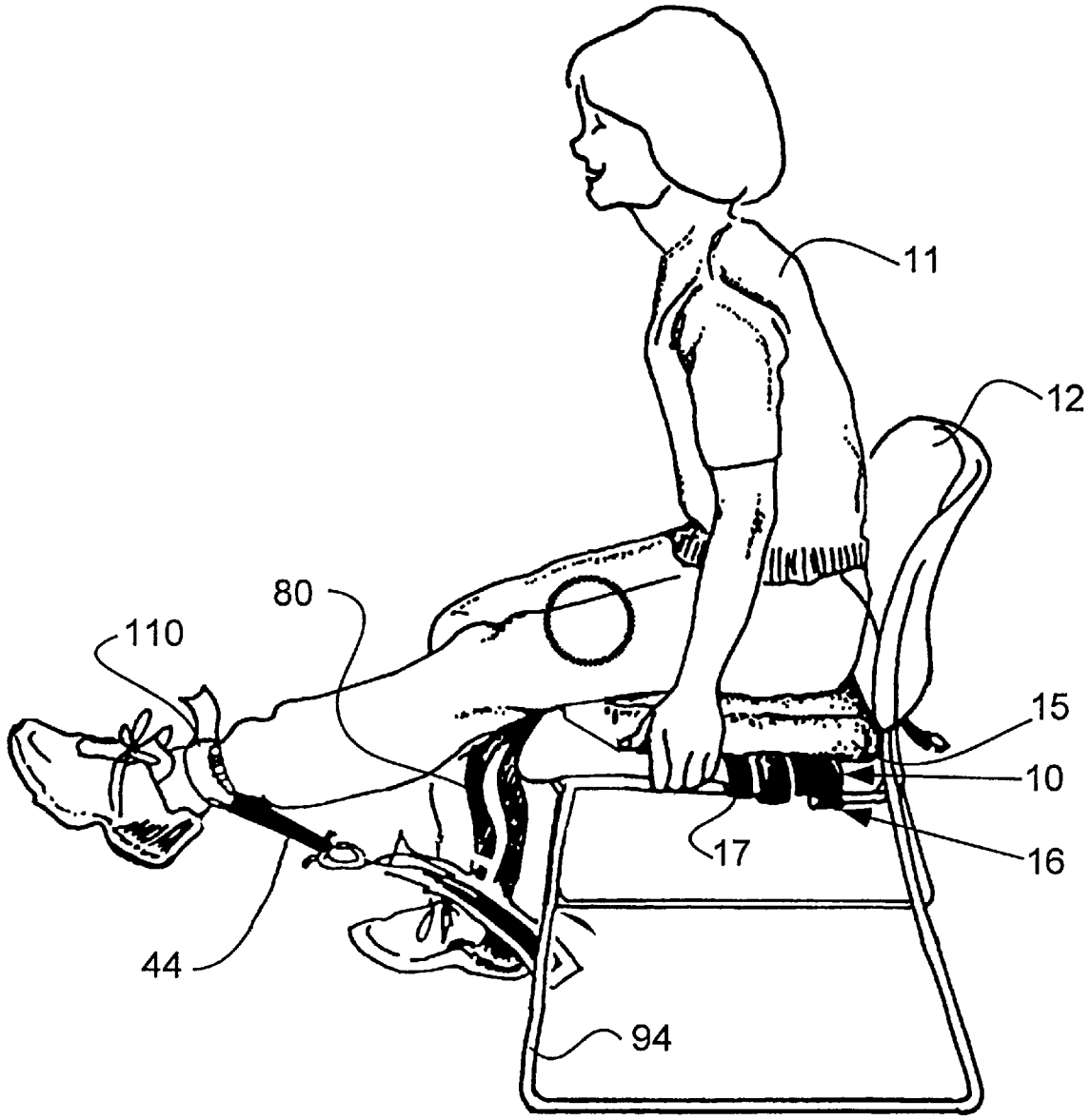
FIG. 3 is a perspective illustration of an exercise device according to the present invention attached to a chair and being used by an exerciser to perform an isotonic leg exercise.

Referring to FIGS. 1–3, there is shown an exercise device 10 according to the present invention being used by an exerciser 11 seated on a chair 12 performing isotonic exercises. The exercise device 10 includes a base pad 14 having a seat pad 15 and a strap 16 connected to seat pad 15 such that strap end portions 17 and 18 extend from opposite sides of seat pad 15. The base pad 14 has a sufficient size to allow body weight of an exerciser to provide a clamping force on the base pad 14 in a manner to be described in greater detail hereinafter.

Figure 4A:
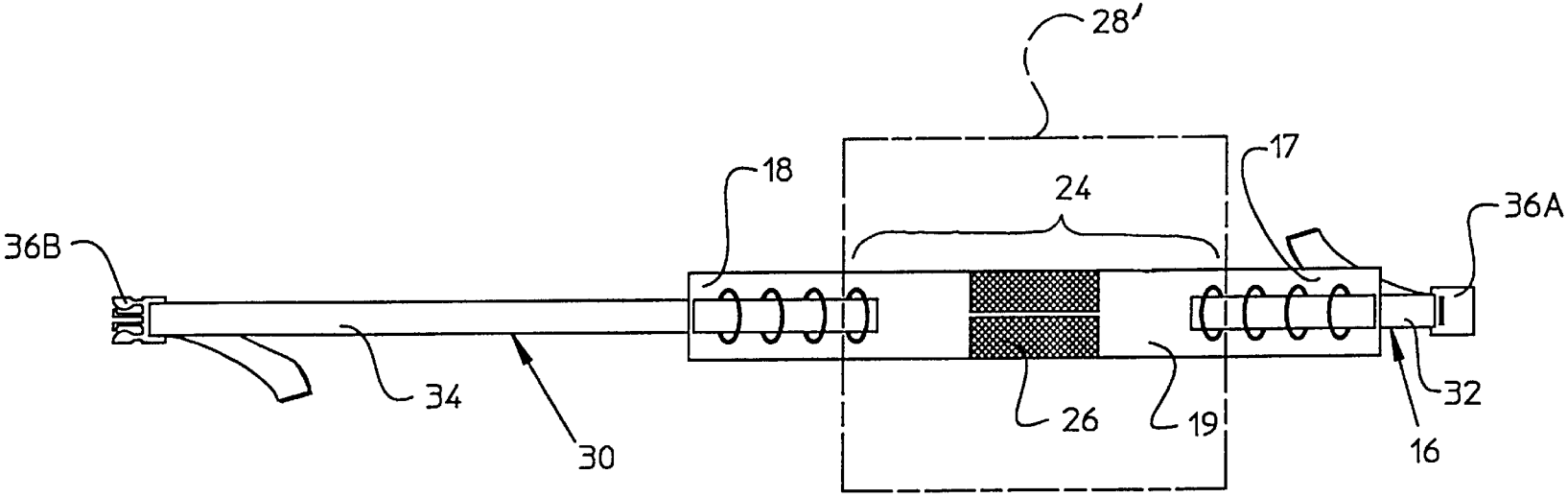
FIGS. 4A and 4B are top and bottom views, respectively, of a strap of an exercise device according to the present invention.
Figure 4B:
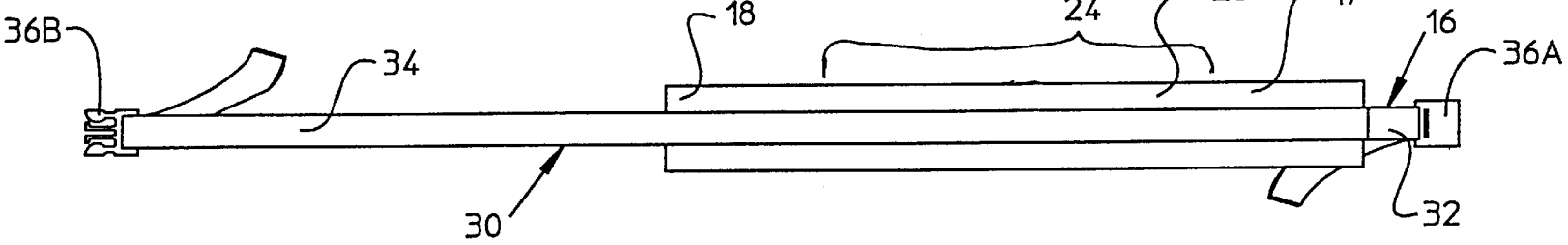
Figure 5:
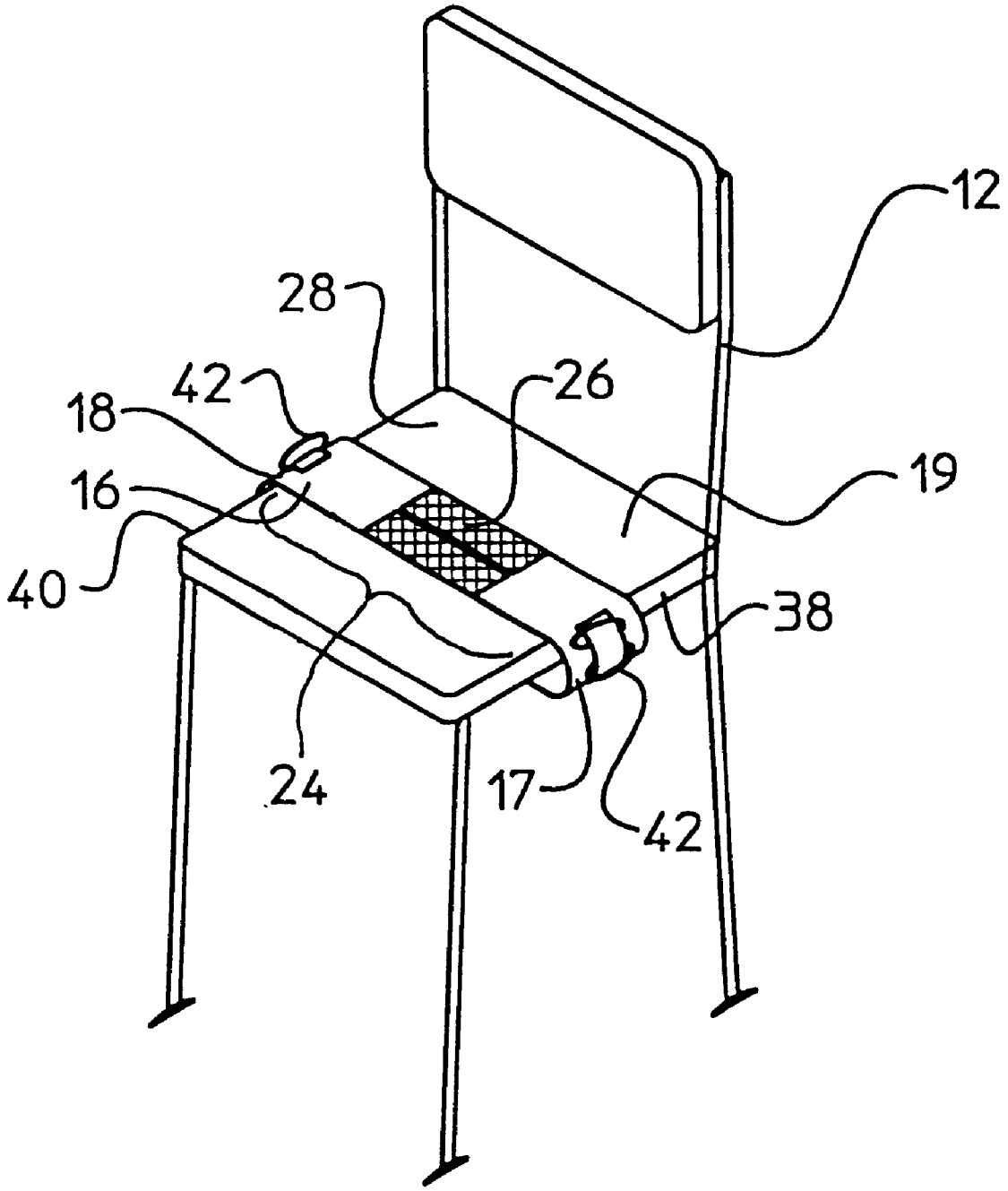
FIG. 5 is a perspective illustration of the strap of FIGS. 4A and 4B attached to the seat portion of a chair.

Referring to FIGS. 4A, 4B and 5, the construction of strap 16 and its connection to chair 12 is shown in greater detail. The strap 16 has opposite face surfaces 19 and 20 and has a strap attachment portion 24 which is integrally located between strap end portions 17 and 18. The strap attachment portion 24 has a section of loop material 26 secured to face surface 19 to serve as part of a hook and loop connection to be described hereinafter. The strap 16 is positioned on the seat portion 28 of chair 12 with face surface 19 directed away from seat portion 28 such that strap attachment portion 24 is positioned on an upper surface of seat portion 28 as best seen in FIG. 5. The position of strap 16 in relation to chair 12 is also seen in FIG. 4A in which the seat portion of chair 12 is shown by phantom line 28'. Each of strap end portions 17 and 18 includes a belt end portion, 32 and 34 respectively, extending from the strap end portion. the preferred embodiment, the belt end portions 32 and 34 are integral components of a belt 30 which is secured to face surface 20 as seen in FIG. 4B. The combined length of belt end portions 32 and 34 is sufficient to allow for connection of terminal ends of the belt end portions with the strap positioned on chair 12.

The belt end portions 32 and 34 carry buckle members 36A and 36B, respectively, which are releasably interconnectable to one another. The buckle members 36A and 36B are most preferably constructed in the manner well known and identified as a side squeeze buckle available from National Moldings Company in Farmingdale, N.Y. A first buckle member includes oppositely located and inwardly deflectable prongs having outwardly located latches and the second buckle member includes a receiver having bearing surfaces for contact with the latches such that removal of the first buckle member is prevented without inward deflection of the prongs. At least one of the buckle members 36A and 36B includes an adjustable belt securement portion, also well known in the construction of side squeeze buckle having spaced apart looping and clamping bars for attachment of the buckle member to the respective belt end portion in which the length of belt which is looped around the belt looping portion may be varied.

When strap 16 is attached to the seat portion 28 of chair 12, at least a portion of the strap end portions 17 and 18 are located along opposite sides 38 and 40, respectively, of the seat portion 28 of chair 12. Each of the strap end portions 17 and 18 includes D-rings 42 attached to the strap end portion at spaced apart locations along the length such that at least one of the D-rings is located adjacent to the side of the seat portion 28. The D-rings are included for attachment of elastic bands 44 to the strap 16, as seen in FIGS. 2–3 and to be described in greater detail hereinafter.

Figure 6B:
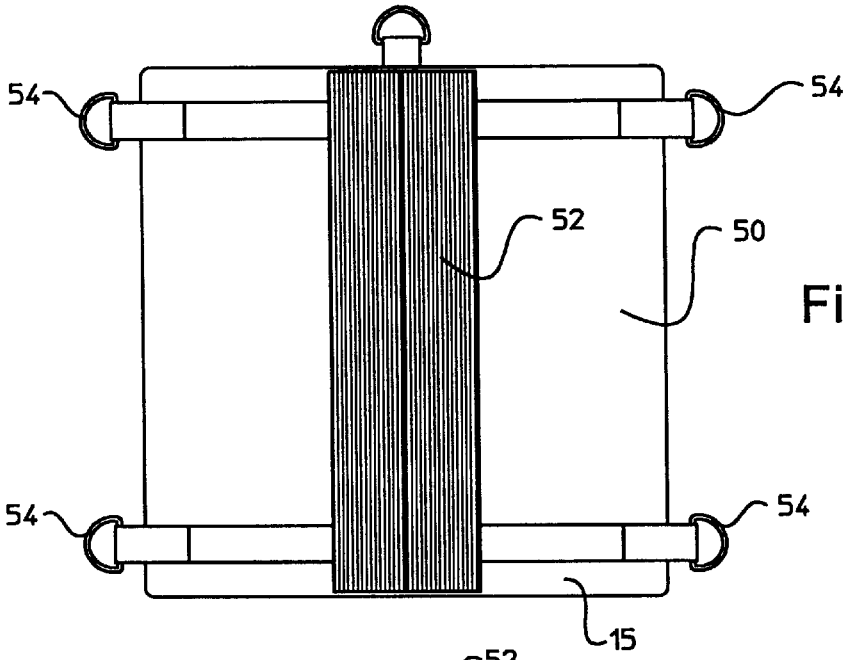
FIGS. 6A–6C are top, bottom and side views, respectively, of a seat pad of an exercise device according to the present invention.
Figure 6C:
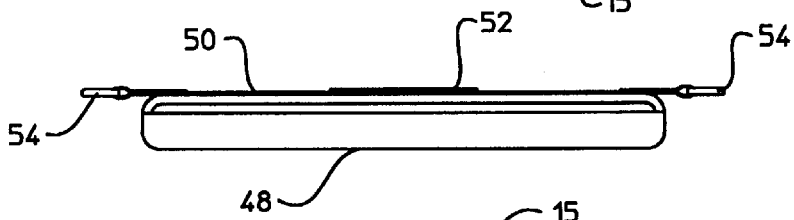
Figure 6A:
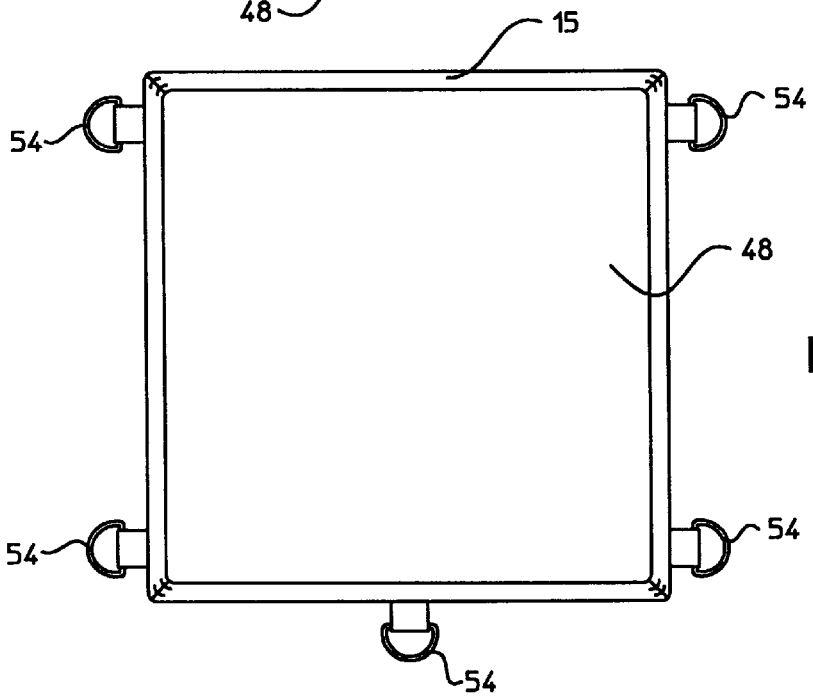

The seat pad 15 of exercise device 10 is shown in detail in FIGS. 6A–6C. The seat pad 15 includes face surface 48 which serves as the support surface for an exerciser 11 using the exercise device 10 as seen in FIGS. 1–3 and an opposite face surface 50 which is directed toward the seat portion 28 of chair 12 and the strap 16 which is secured thereto. The seat pad 15 includes a layer of hook material 52 which is secured to face surface 50 adjacent to a central portion of face surface 52 for interconnection with loop material 26 of strap attachment portion 24 to form the hook and loop connection referred to previously. The seat pad 15 shown in FIGS. 6 also includes D-rings 54 at spaced apart locations around the periphery of face surface 50 for attachment of elastic bands to the seat pad 15. The seat pad 15 serves to distribute gravity forces applied to face surface 48 of seat pad 15 from the body weight of an exerciser 11 to the seat portion 28 of chair 12 through the strap 16 thereby providing a clamping force between the seat pad 15 and the seat portion 28 of chair 12. As seen in FIGS. 1–3, the exerciser 11 using the exercise device 10 supplies the desired clamping force through gravity forces acting on the exerciser to aid in anchoring the strap 16 to the chair 12 and resist forces applied to the strap 16 during isotonic exercises illustrated in FIGS. 1–3.

Figure 7:
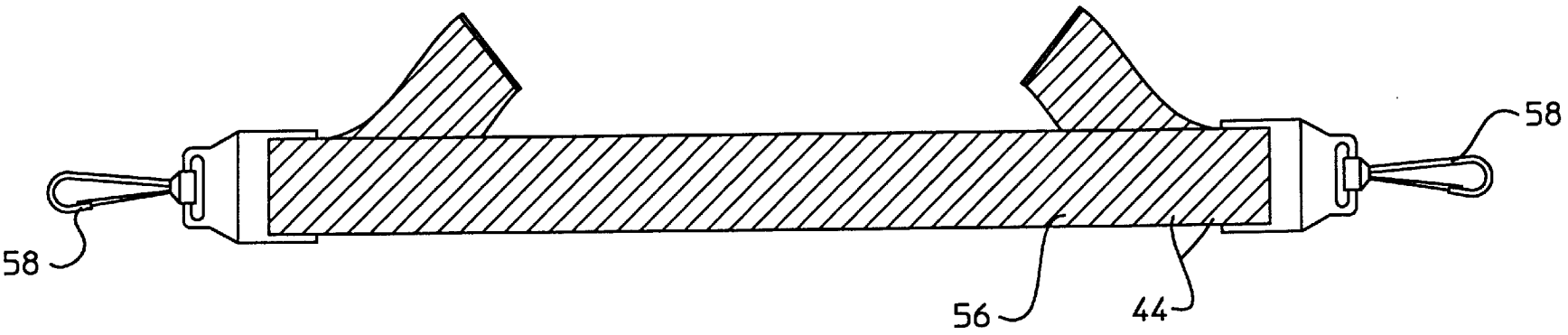
FIG. 7 is a top view of an elastic band of an exercise device according to the present invention.

Referring to FIG. 7, there is illustrated in greater detail an elastic band 44. The elastic band has a length of latex material 56 and includes snap hooks 58 secured to opposite ends of the elastic band. Each of the snap hooks 58 includes a belt securement portion most preferably constructed in a similar manner to the belt securement portion described previously for the buckle members of strap 16 having spaced apart belt looping and belt clamping members for attachment of the snap hooks 58 to terminal end portions of the elastic band. The belt securement portions of snap hooks 58 provide for adjustment in the length of the elastic band to be stretched during isotonic exercises which is that portion of the elastic band 44 located between the snap hooks 58. Each of the hook 5 8 includes a per se well known j-shaped member and spring clip for securement of an end of the elastic band 44 to a D-ring 42 of strap 16 or a D-ring 54 of seat pad 15 to allow the exerciser 11 to perform the isotonic exercises as illustrated in FIGS. 1–2. Alternatively, the elastic band 44 is attachable to D-rings providing for the isotonic leg exercises shown in FIG. 3 to be described below. The spring clip of snap hook 58 provides a quick disconnect feature to separate the elastic band 44 from the D-rings to which the elastic band is attached.

Figure 8B:
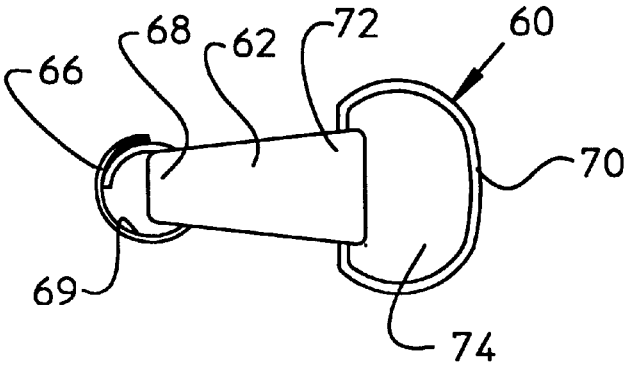
FIGS. 8A and 8B are top and side views, respectively, of a hand band of an exercise device according to the present invention.
Figure 8A:
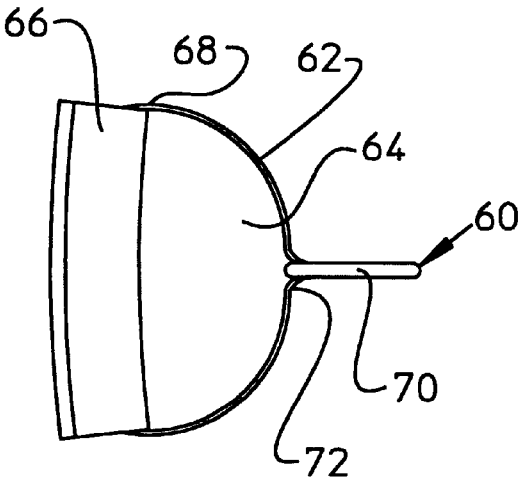
Figure 8C:
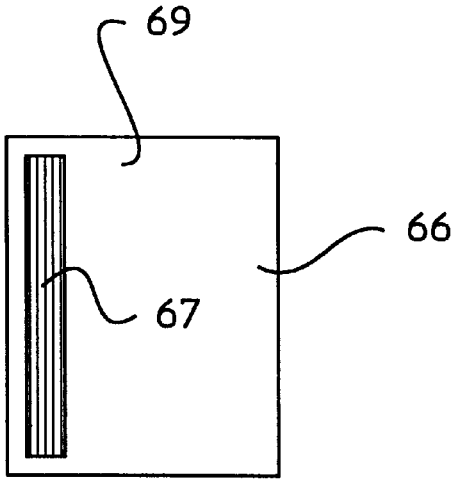
FIG. 8C is the hand grip of the hand band of FIGS. 8A and 8B shown in an unrolled condition.

The exercise device 10 includes hand bands 60 for performing isotonic exercises such as those illustrated in FIGS. 1–2. As seen in greater detail in FIGS. 8A–8C, the hand band 60 has an endless loop 62 sufficient in size to form a central opening 64 for encircling the palm portion of an exerciser's hand, excluding the thumb, when the hand band 60 is grasped by the exerciser. The hand band 60 also includes a grip 66 attached to a side 68 of endless loop 62 which is grasped by the fingers of an exerciser for application of force to the elastic band 44. The endless loop 62 of band 60 can also be arranged to encircle an exerciser's foot for isotonic foot, ankle and leg exercise. FIG. 8C shows hand grip 66 in an unrolled condition to reveal a layer of hook material 67 on surface 69 which joins with a layer of loop material on an opposite surface of hand grip 66, not seen, to form a hook and loop connection for securing hand grip 66 to endless loop 62. A D-ring 70 is secured to a side 72 of endless loop 62 opposite side 68 providing for attachment of one of the snap hooks 58 of an elastic band 44 as seen in FIGS. 1 and 2.

Figure 9A:
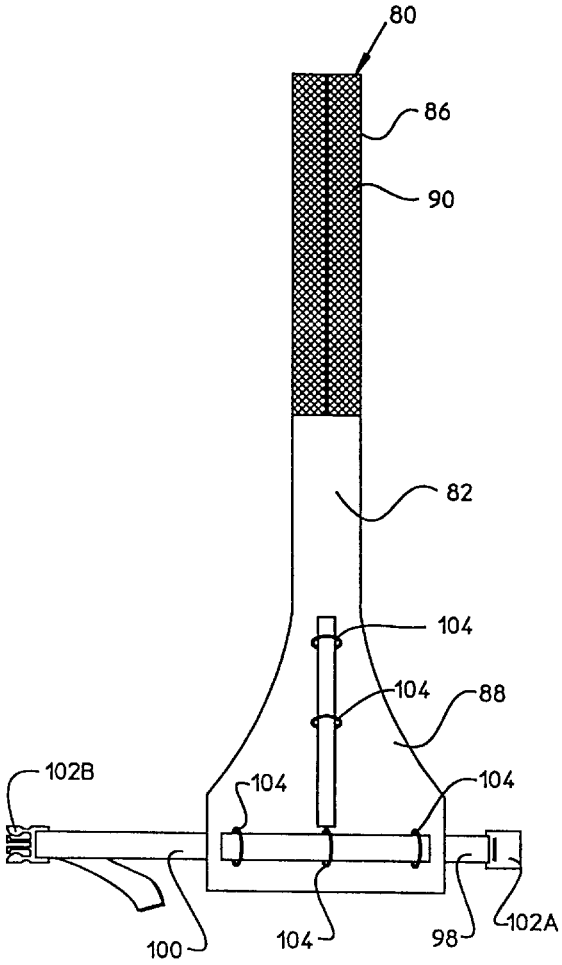
FIGS. 9A and 9B are top and bottom views, respectively, of a front flap of an exercise device according to the present invention.
Figure 9B:
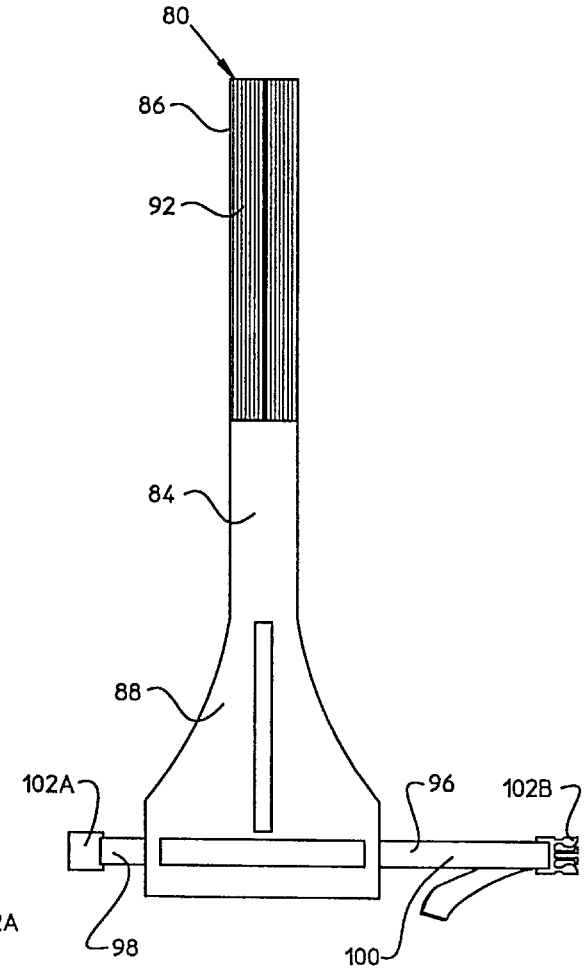
Figure 10:
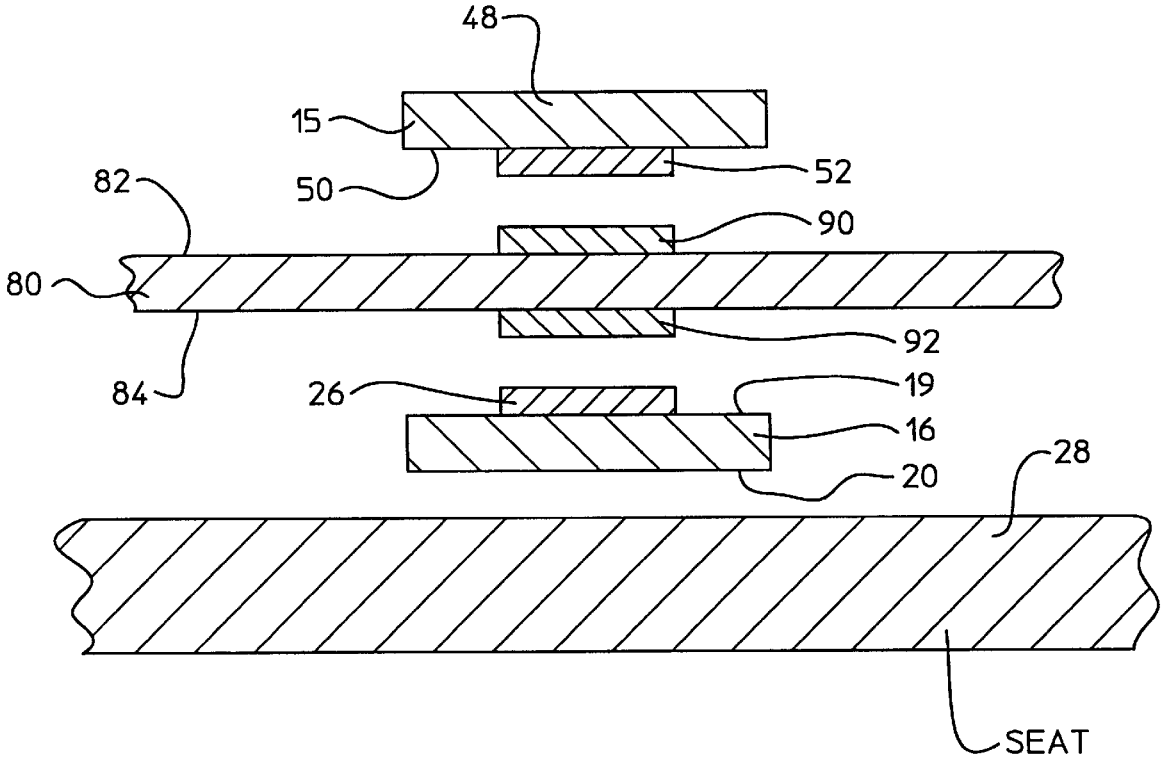
FIG. 10 is a schematic illustration showing the hook and loop connections between the front flap of FIGS. 9A and 9B and a strap and seat pad of an exercise device according to the present invention.

The exercise device 10 also includes an elongated front flap 80 which provides for the performance of isotonic exercises at a site downwardly along a forward portion of a chair, such as the leg exercise shown in FIG. 3. The front flap 80, shown in detail in FIGS. 9A and 9B, has opposite face surfaces 82 and 84 and has a flap anchor section 86 at one end and a flap attachment section 88 at an opposite end. The flap anchor section 86 has a layer of loop material 90 adhered to face surface 82 and a layer of hook material adhered to face surface 84. The hook and loop connections are schematically illustrated in FIG. 10 in which is seen that the front flap 80 is positioned between seat pad 15 and strap 16 with face surface 82 directed towards face surface 50 of seat pad 15 and face surface 84 directed towards face surface 19 of strap 16 such that connection is made between hook material 52 of seat pad 15 and loop material 90 of front flap 80 and between hook material 92 of front flap 80 and loop material 26 of strap 16. The connection of the front flap 80 to the exercise device 10 is anchored further by the clamping force applied by the exerciser through gravity forces from the exerciser's weight in the manner described previously.

As seen in FIG. 3, the front flap 80 extends to a location downwardly along a forward portion of the chair 12 at which flap attachment section 88 is secured to lower portions of forward legs 94 in the following manner. Flap attachment section 88 includes an anchor strap 96 secured to face surface 84 having ends 98 and 100 extending beyond opposite edges of the flap attachment section 88. Buckle members 102A and 102B, similar in construction to the buckle members 36A and 36B of strap 16, are secured to anchor strap ends 98 and 100, respectively, in the manner described previously for buckle members 36A and 36B. Each of ends 98 and 100 are positioned around one of forward legs 94 of chair 12 and are releasably interconnected through buckle members 102A and 102B to secure the flap attachment section 88 to the downwardly forward location of chair 12. The flap attachment section 88 also includes D-rings 104 which are secured to face surface 82 for attachment of elastic bands 44 in the manner described previously.

Figure 11A:
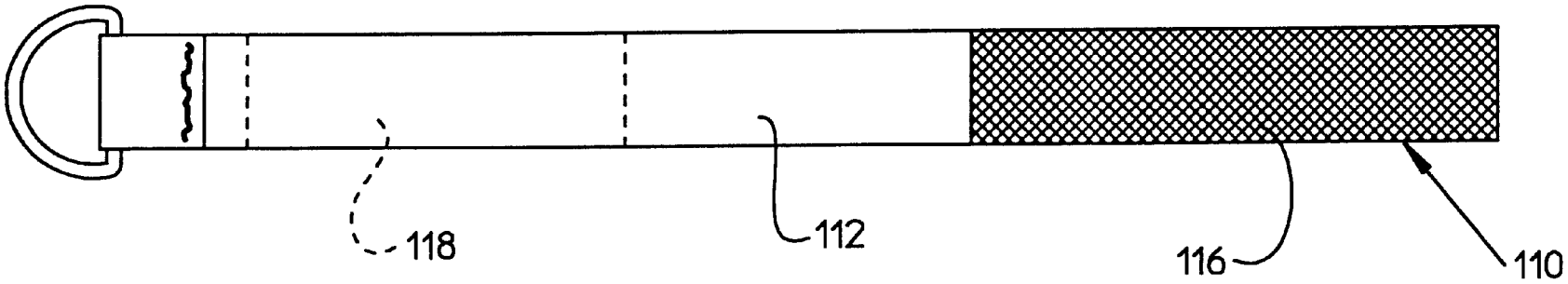
FIGS. 11A and 11B are top and bottom views, respectively, of an ankle strap of an exercise device according to the present invention.
Figure 11B:
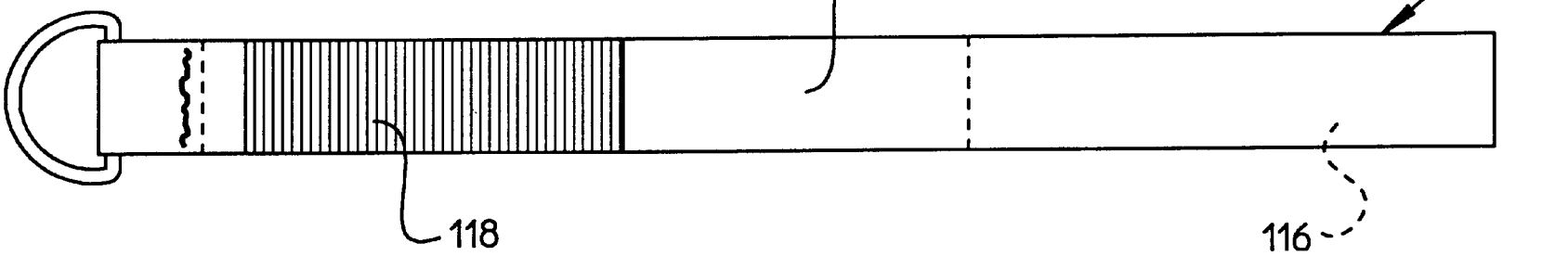

The exercise device includes ankle straps 110 providing for isotonic leg exercises, such as that seen in FIG. 3. The ankle strap 110, shown in detail in FIG. 11A and 11B, includes opposite face surfaces 112 and 114. The ankle strap 110 has a layer of loop material 116 located on face surface 112 at an end of the ankle strap 110 and a layer of hook material 118 located on face surface 114 at an end of the ankle strap 110 opposite to the hook material 116. The ankle strap 110 also includes a D-ring secured to the end of ankle strap 110 at which the hook material 118 is located such that when the ankle strap 110 is positioned around an exerciser's ankle with face surface 112 directed towards the exerciser and the end having loop material 116 is passed through D-ring 120 to form an enclosure around the ankle, the loop material 116 can be brought into a confronting relationship with hook material 118 to form a hook and loop connection. The hook material 116 and loop material 118 are sufficient in length to allow adjustability in the size of the enclosure formed by ankle strap 110 for different size ankles. With the ankle strap 110 in position on the ankle of an exerciser, one of the snap hooks 58 of an elastic band 44 is attached to the D-ring 120 and the opposite hook 58 of the elastic band 44 is attached to one of D-rings 104 of flap attachment section 88 of front flap 80.

The exercise device of the present invention is designed to provide isotonic arm exercises by using an ankle strap 1 10 to connect an exerciser's leg to a "D" ring at one lateral side of the flap attachment portion 88. A hand band 60 is connected by an elastic band 44 to a different one of the "D" rings on the flap attachment portion in the general vicinity of the attachment site of the connection to the ankle strap. The isotonic exercise is carried out extending the exerciser's arm forwardly with the elastic band extending downwardly between the exerciser's legs.

The exercise device of the present invention allows the exerciser to perform a variety of isotonic exercises throughout partial or full range of motion for both the axial and appendicular skeletal regions. It allows motion through resistive exercises in the sagittal, frontal and transverse planes of motion. In addition, the exercises can be performed along all three axes of motion, namely the coronal, frontal and sagittal axes. The areas of utilization for this exercise device include but are not limited to the shoulder complex, the elbow, the wrist, the hand, the cervical, thoracic and lumbar spine, the hip, the knee, and the foot and ankle regions.

The intended use of the exercise device of the present invention is multivariant. It may be used in the case of rehabilitation following surgical procedures as well as conservative treatment for various injuries both musculoskeletal and neuromuscular in nature. In addition, it may be used for routine and recreational exercise for the purpose of strengthening and conditioning various muscle groups for the trunk and extremities. The type of resistance provided by the exercise device of the present invention is progressive resistance with isotonic movement providing both concentric and eccentric contractions throughout the range of motion.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An exercise device adapted for attachment to a chair, said exercise device including: a base pad of a sufficient size to allow body weight of an exerciser to provide a clamping force on the base pad against a seat portion of a chair; said base pad including strap end portions releasably interconnectable for securement to a part of the seat portion of a chair; at least one of said base pad and said strap end portions including an elastic band secured thereto, said elastic band having a length sufficient to allow an exerciser to perform isotonic exercises; and an elongated front flap including a flap attachment section extending to a flap anchor section supported by said base pad for positioning said attachment section at a site downwardly along a forward portion of a chair, an ankle strap including an elastic band secured to said attachment section for isotonic exercise, and an anchor strap secured to said attachment section for providing resistance against a reaction force imposed on said attachment section by said ankle strap.

2. The exercise device according to claim 1 wherein said strap end portions include a buckle.

3. The exercise device according to claim 1 wherein said base pad includes a plurality of elastic band attachment members spaced about an outer periphery of said base pad for mounting elastic bands for isotonic exercise.

4. The exercise device according to claim 1 wherein said strap end portions include a plurality of elastic band attachment members for mounting elastic bands for isotonic exercise.

5. The exercise device according to claim 1 wherein said strap end portions are integral with a strap attachment portion having a fastener for support by a face surface of said base pad directed toward the seat portion of a chair.

6. The exercise device according to claim 5 wherein said fastener comprises an elongated strip of one of hook and loop materials engaged at an intersection with an elongated strip of the other of the hook and loop materials secured to said face surface of said base pad.

7. The exercise device according to claim 1 wherein said flap anchor section includes a fastener for support by a face surface of said base pad directed toward the seat portion of a chair.

8. The exercise device according to claim 7 wherein said fastener comprises one of hook and loop materials and the other of the hook and loop materials supported by said face surface of said base pad.

9. The exercise device according to claim 7 wherein said strap end portions are integral with a strap attachment portion having a fastener for support by a face surface of said base pad directed toward the seat portion of a chair.

10. The exercise device according to claim 9 wherein one of said strap attachment portion and said flap anchor section include hook and loop material adhered to opposite face surfaces thereof and the other of said strap anchor portion and said flap attachment section and a face surface of said base pad directed toward the seat portion of a chair having one of either hook and loop materials whereby said strap attachment portion and said flap anchor section are anchored by hook and loop materials to said face surface of said base pad.

11. The exercise device according to claim 1 further including two endless hand bands each having a central opening sufficient in size for encircling the palm section of an exerciser's hand and excluding the thumb, said endless hand bands including securement members for attaching said elastic band thereto.

12. The exercise device according to claim 1 wherein said base paid is of a sufficient size to allow body weight of an exerciser to provide a clamping force on the base pad against a seat portion of a chair.

13. The exercise device according to claim 12 further including a fastener for interconnecting said base pad with said strap.

14. The exercise device according to claim 13 wherein said fastener includes hook and loop materials.

15. The exercise device according to claim 1 further including an elastic band attachment member including an elastic band and a hook with a spring clip joined to each of opposite ends of said elastic band, the spring clip at each of the opposite ends of said elastic band serving to releasably interconnect an exerciser's body to a chair for an isotonic exercise.

16. An exercise device adapted for attachment to a chair for exercising the shoulder complex, elbow, wrist, hand, cervical, thoracic spine and lumbar spine, hip, said exercise device including:

a seat pad having opposite lateral sides between an exerciser support surface directed away from a seat portion of a chair;

a strap having a strap attachment portion integrally located between strap end portions, said strap attachment portion traversing a seat portion of a chair and secured to a chair by said strap end portions;

an elastic band secured to at least one of each of opposite lateral sides of said seat pad or said strap end portions, said elastic band having a length sufficient to allow an exerciser to perform isotonic exercises; and a fastener releasably connecting said seat pad at a desired location to said strap with said exerciser support surface arranged to receive and transmit gravity force of an exerciser to said strap and allow access to said elastic band at each of said opposite lateral sides of said seat pad.

17. The exercise device according to claim 16 wherein said seat pad includes a plurality of elastic band attachment members spaced about an outer periphery of said seat pad for mounting elastic bands for isotonic exercise.

18. The exercise device according to claim 16 wherein said strap end portions include a plurality of elastic band attachment members for mounting elastic bands for isotonic exercise.

19. The exercise device according to claim 16 wherein said strap end portions are integral with a strap attachment portion having a fastener for support by a face surface of said seat pad directed toward the seat portion of a chair.

20. The exercise device according to claim 19 wherein said fastener comprises an elongated strip of one of hook and loop materials engaged at an intersection with an elongated strip of the other of the hook and loop materials secured to said face surface of said seat pad.

* * * * *